US007481598B2

(12) United States Patent
Jankovsky

(10) Patent No.: US 7,481,598 B2
(45) Date of Patent: Jan. 27, 2009

(54) EXTENDING BARRIER ARM OPERATOR SYSTEM AND METHOD

(75) Inventor: Tom J. Jankovsky, South Elgin, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 11/497,498

(22) Filed: Aug. 1, 2006

(65) Prior Publication Data

US 2008/0038055 A1 Feb. 14, 2008

(51) Int. Cl.
*E01F 9/00* (2006.01)
*E01F 9/011* (2006.01)
*E01F 9/019* (2006.01)

(52) U.S. Cl. ..... 404/6; 49/49

(58) Field of Classification Search ..... 404/6, 404/9; 49/49; 52/67
See application file for complete search history.

(56) References Cited

U.S. PATENT DOCUMENTS 3,161,275 A * 12/1964 Sullivan ..... 194/297
4,591,868 A 5/1986 Cusey et al.
4,782,628 A * 11/1988 Gaddis ..... 49/340
4,825,192 A * 4/1989 Wells ..... 340/433
4,865,110 A * 9/1989 Seal ..... 160/332
4,893,119 A * 1/1990 Nasatka ..... 340/928
4,992,788 A * 2/1991 Arndt ..... 340/908
5,038,136 A * 8/1991 Watson ..... 340/480
5,092,708 A * 3/1992 Kruger ..... 405/103
5,211,503 A * 5/1993 Quittner ..... 404/6
5,406,251 A * 4/1995 Leis ..... 340/433
5,804,938 A * 9/1998 Richmond et al. ..... 318/282
6,213,047 B1 * 4/2001 Means et al. ..... 116/28 R
6,267,332 B1 * 7/2001 Almblad ..... 246/294
6,632,044 B2 * 10/2003 Duckett ..... 404/6
6,652,182 B1 11/2003 Ellefson
6,997,638 B2 * 2/2006 Hensley et al. ..... 404/6
7,037,028 B1 * 5/2006 Donohoe et al. ..... 404/6
7,048,467 B2 * 5/2006 Burns et al. ..... 404/6
7,104,721 B2 * 9/2006 Rogers et al. ..... 404/6
7,106,214 B2 * 9/2006 Jesadanont et al. ..... 340/932.2
7,125,198 B2 * 10/2006 Schiefferly et al. ..... 404/6
7,164,352 B2 * 1/2007 Nelson ..... 340/472
7,220,076 B2 * 5/2007 Boll ..... 404/6
2003/0165356 A1 * 9/2003 Breed ..... 404/6
2004/0088923 A1 * 5/2004 Burke ..... 49/49
2005/0201827 A1 * 9/2005 Rastegar et al. ..... 404/6
2005/0232694 A1 * 10/2005 Fitzgibbon ..... 404/6
2005/0238424 A1 * 10/2005 Burns et al. ..... 404/6
2006/0078378 A1 * 4/2006 Burns et al. ..... 404/6
2006/0228177 A1 * 10/2006 Allain et al. ..... 404/6
2007/0008710 A1 * 1/2007 Nielson et al. ..... 362/20

* cited by examiner

*Primary Examiner*—Raymond W Addie
(74) *Attorney, Agent, or Firm*—Fitch, Even, Tabin & Flannery

(57) ABSTRACT

A moveable barrier operator system includes a telescoping barrier arm. A motor is coupled to the telescoping barrier arm for extending the telescoping barrier arm from a retracted position to an extended position and retracting the arm from the extended position to the retracted position. A controller is coupled to the motor for selectively activating the motor to extend and retract the arm.

21 Claims, 4 Drawing Sheets

200
202
204
206
208
210
212
214
216
218
220
222
224
226
228
230
232
234
300
302
304
306
308
310
312
MOTOR-ARM INTERFACE
MOTOR
CONTROLLER
SENSOR INTERFACE
RF INTERFACE
POWER SENSOR
POWER SUPPLY
MANUAL OVERIDE INDICATOR
EXTERNAL PRESENCE SENSOR
TRANSMITTER

EXTENDING BARRIER ARM OPERATOR SYSTEM AND METHOD

FIELD OF THE INVENTION

The field of the invention relates to barrier operator systems and, more specifically, to the barriers used in these systems.

BACKGROUND

Different types of moveable barrier operators have been sold over the years and these systems have been used to actuate various types of moveable barriers. For example, garage door operators have been used to move garage doors and gate operators have been used to open and close gates.

Such barrier movement operators may include various mechanisms to open and close the barrier. For instance, a wall control unit may be coupled to the barrier movement operator and sends signals to a head unit thereby causing the head unit to open and close the barrier. In addition, operators often include a receiver unit at the head unit to receive wireless transmissions from a hand-held code transmitter or from a keypad transmitter, which may be affixed to the outside of the area closed by the barrier or other structure.

As mentioned, gate operators are one type of barrier operator and are often used to control entry to areas such as parking lots, buildings, garages, and toll roads. Gate operators are typically constructed of a rigid, single-piece extendable arm. The arm, for instance, constructed of a material such as wood or metal, is positioned parallel to the ground to prevent entry to a protected area. On the other hand, when entry is desired, the arm is moved in an arcuate path upward to allow the vehicle or person to pass through the opening into the protected area.

Unfortunately, the barriers used in these previous systems are bulky and require the presence of an open arc of space to allow the barrier to be placed in the open position. This can be a problem in many circumstances, such as in many enclosed areas, where upward space is at a premium. In addition, as the arm swings downward, the bottom of the barrier arm needs to be protected from impacting an obstruction. For instance, various secondary safety devices (e.g., motion sensors, IR beams) need to be employed to prevent damage from obstructions. These devices can be expensive and bulky, leading to increased system cost and user inconvenience.

SUMMARY

A barrier operator is provided having a telescoping arm. The use of a telescoping arm saves space and does not require an open arc of space above the arm. Since arcuate movement of the arm is not required (i.e., only the tip of the arm moves), only the tip area of the arm need be protected from obstructions. Consequently, simpler and less expensive secondary safety devices can be used to protect the tip and these devices are not needed to protect the rest of the barrier.

In many of these embodiments, a moveable barrier operator system includes a telescoping barrier arm. A motor is coupled to the telescoping barrier arm for extending the telescoping barrier arm from a retracted position to an extended position and retracting the arm from the extended position to the retracted position. A controller is coupled to the motor for selectively activating the motor to extend and retract the arm.

A secondary safety device may be included in the system to prevent the telescoping barrier arm from contacting an object in a pathway of the telescoping barrier arm. In one example, the secondary safety device may be positioned to protect the tip of the arm from impacts with obstructions.

Other devices may also be used in conjunction with the telescoping barrier arm in the system. For example, a detector for detecting a power outage may be used. In one example, the controller may be programmed to actuate the motor upon detection of a power outage and the barrier arm may be retracted, held in a current position, or extended. In another example, a manual override mechanism may be provided to manually override actions of the controller.

The system may be operated according to various modes of operation. For example, the controller may operate the telescoping barrier arm in a failsafe mode that allows a user to escape the telescoping barrier arm upon detection of a predetermined condition, such as a collision with the user. In another example, the controller may operate the telescoping barrier arm in a fail-secure mode that excludes users from entering a secure area protected by the operator upon detection of a predetermined condition such as the detection of an unauthorized attempt to gain entry to the secure area.

Various types of mechanisms can be used to extend the telescoping barrier arm from a closed position to an open position. For instance, the motor may drive the telescoping barrier arm into its extended position using springs.

Thus, a barrier operator having a telescoping arm is provided. The telescoping arm saves space and does not require an open arc of space above the arm. Since arcuate movement of the arm is not required, only the tip area of the arm need be protected from collisions with obstructions, and, consequently, simpler and inexpensive secondary safety devices can be used in the system.

Skilled artisans will appreciate that elements in the figures are illustrated for ease of understanding and have not necessarily been drawn to scale. For example, the dimensions of some of the elements in the figures may be exaggerated relative to other elements to help to improve understanding of various embodiments of the present invention. Also, common but well-understood elements that are useful in a commercially feasible embodiment are often not depicted in order to facilitate a less obstructed view of the various embodiments of the present invention.

DESCRIPTION

Figure 1A:
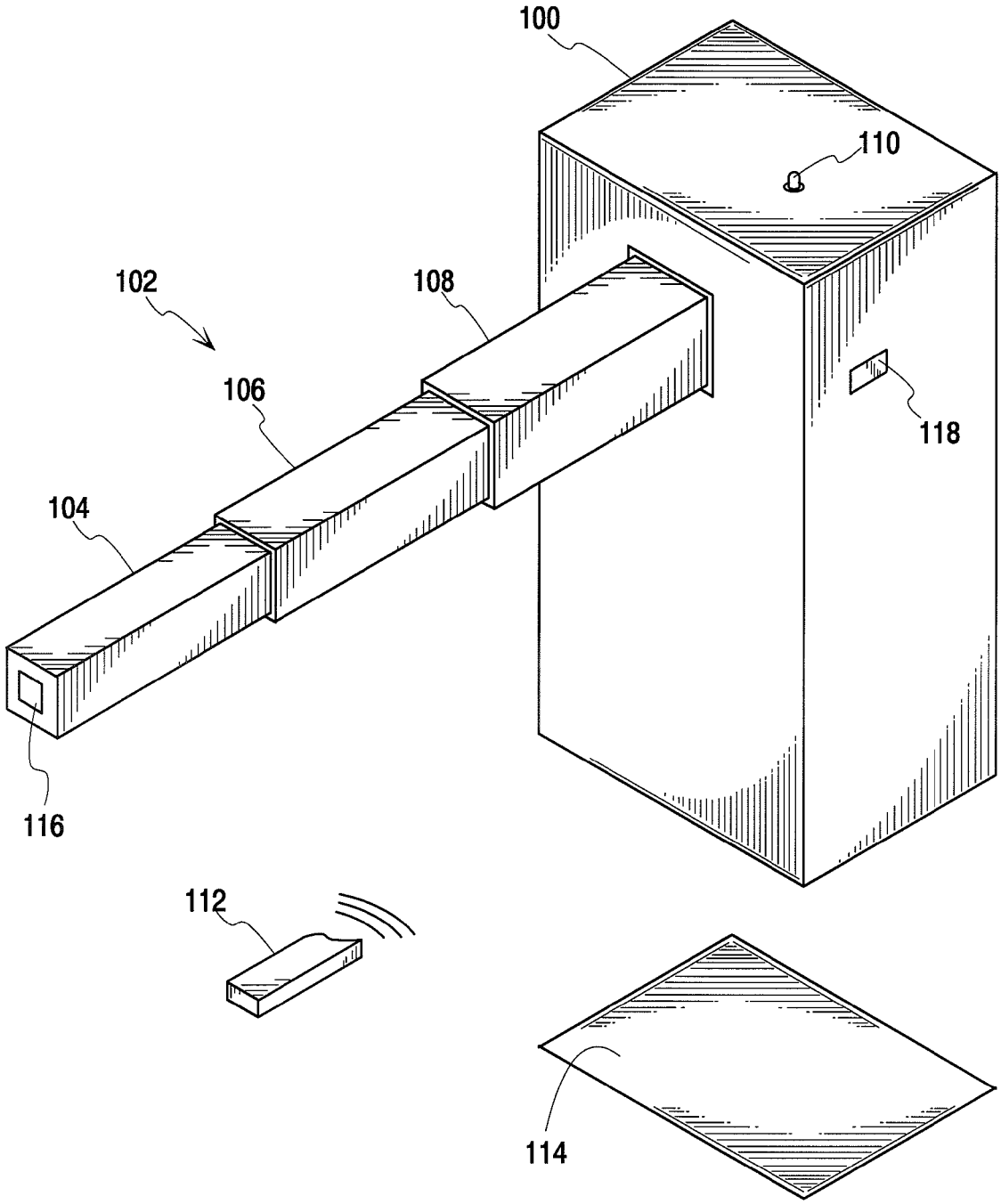
FIG. 1*a* is a perspective drawing of a barrier operator system with a telescoping arm with the arm extended according to the present invention.

Referring now to the drawings and especially FIG. 1*a*, one example of a barrier operator system using a telescoping barrier arm is described. A moveable barrier operator system includes a chassis 100. The chassis 100 houses a controller, a motor, and a mechanism for extending and retracting a telescoping barrier arm 102. Alternatively, the mechanism for extending and retracting the arm may be positioned outside of the chassis 100.

The barrier arm 102 includes a first member 104, a second member 106, and a third member 108. This is one example only and it will be appreciated that the barrier arm may include any number of members. Each of the members 104, 106, and 108 are hollow. The width of the first member 104 is less than the width of the second member 106. The width of the second member 106 is less than the width of the third member 108. Consequently, in this example, when in the retracted position, the first member is housed within the second member 106. Together, the first and second members 104 and 106 are then housed within the third member. Finally, when fully retracted, the first second, and third members 104, 106, and 108 are housed the chassis 100.

The barrier operator system may be actuated in a number of different ways. For example, a transmitter 112 may be used to send a signal to an antenna 110 to the barrier operator system. Once received, the signal may cause the barrier 102 to be extended or retracted. In another example, a user or vehicle may be enter a magnetic sensing loop 114, which causes a signal to be sent to the barrier operator system. This, in turn, may cause the barrier arm to be extended or retracted. Other examples of actuators are possible.

Other devices may also be used in conjunction with the moveable barrier operator system. For example, a detector for detecting a power outage may be positioned within the chassis 100. In one example, the barrier operator may be actuated upon detection of a power outage and the barrier arm 102 may be retracted, held in a current position, or extended.

A manual override mechanism may also be provided in the system to manually override actions of the system. For example, a manual override button 118 may be provided to allow a user to manually override the actions of the controller.

The system may additionally be operated according to various modes of operation. For example, the operator may operate the telescoping barrier arm in a failsafe mode that allows a user to escape the telescoping barrier arm 102 upon detection of a predetermined condition such as a collision with the user or object. In another example, the operator may operate the telescoping barrier arm 102 in a fail-secure mode that excludes users from entering a secure area protected by the arm 102 upon detection of a predetermined condition such as the detection of an unauthorized attempt to gain entry into the secure area.

The barrier arm 102 may have a detector 116 that detects the presence of objects in the path of the arm 102 as the arm 102 extends. In one approach, the sensor is positioned on the tip of the first member 104. Alternatively, the detector may be positioned in other locations such as above or below any of the members 104, 106, and 108. The detector could be a photobeam detector (retro-reflective object detecting) or a pressure detector to give two examples.

Figure 1B:
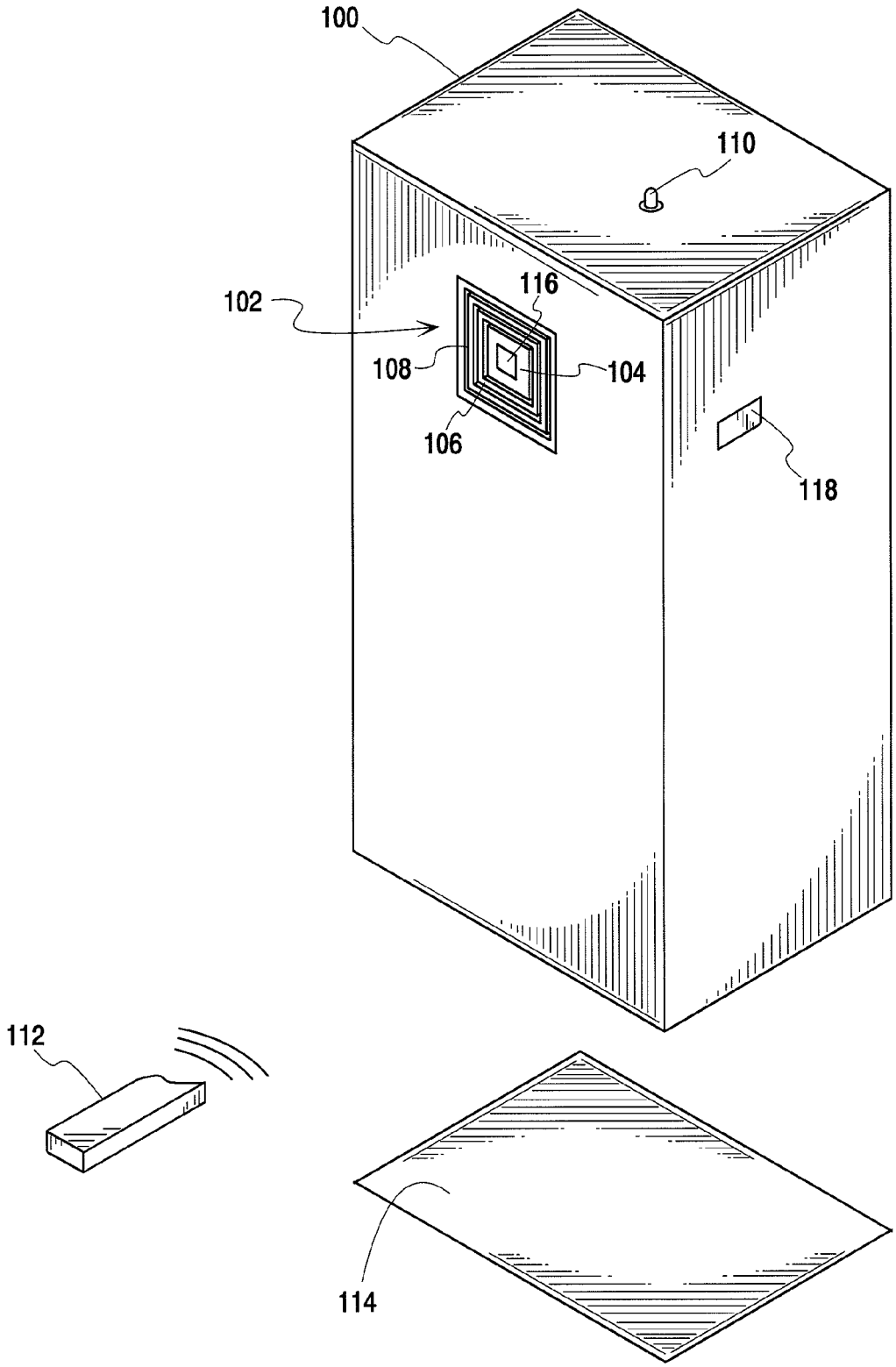
FIG. 1*b* is perspective drawing of a barrier operator system with a telescoping arm with the arm retracted according to the present invention.

Referring now to FIG. 1*b*, an example of the barrier system of FIG. 1 with the telescoping barrier arm in the retracted position is described. In this example, the members 104, 106, and 108 have been fully retracted into the chassis 100. Alternatively, at least a small length of these members may extend slightly outside the chassis 100. In still another example, the members 104, 106, and 108 may be placed fully outside the chassis 100 when retracted. In this case, the members 104, 106, and 108 may be supported by brackets, stands, or other supporting mechanisms.

Figures 2, 3A, 3B:
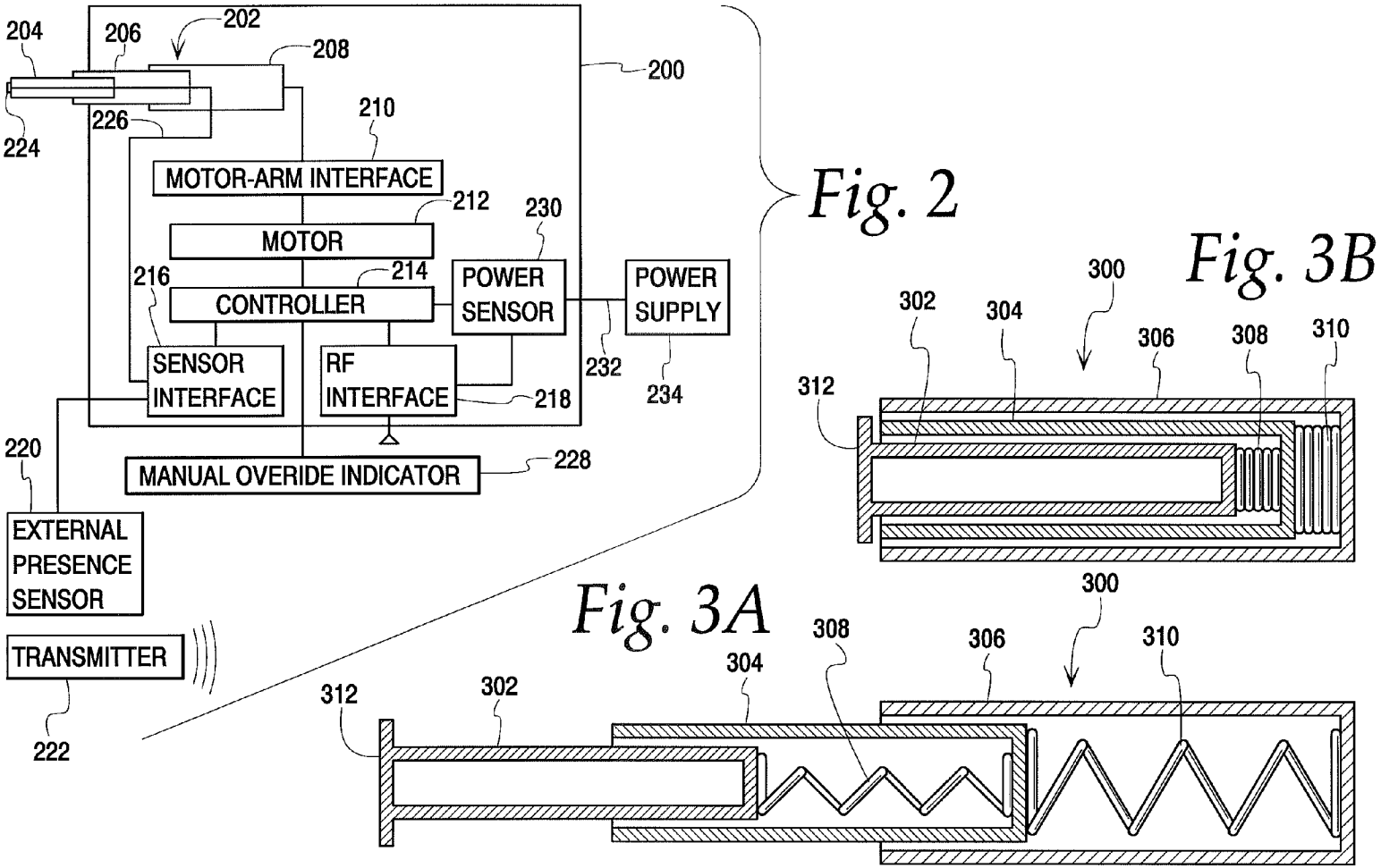
FIG. 2 is block diagram of a barrier operator system with a telescoping according to the present invention.
FIG. 3*a* is a cross sectional view of a telescoping barrier arm in the extended position according to the present invention.
FIG. 3*b* is a cross sectional view of a telescoping barrier arm in the retracted position according to the present invention.

Referring now to FIG. 2, one example of a moveable barrier system using a telescoping barrier arm is described. A moveable barrier operator chassis 200 includes a telescoping barrier arm 202, which is coupled to a motor 212 via a motor/arm interface 210. A controller 214 is coupled to and controls the operation of the motor 212.

The controller 214 is also coupled to a sensor interface 216 and an RF interface 218. The sensor interface 216 receives signals from an obstruction detection sensor 224 (at the tip of the telescoping barrier arm 202) via a wire 226. The sensor interface 216 also receives signals from an external presence sensor 220.

The controller 214 additionally receives signals from a manual override indicator 228. The manual override indicator 228 may be a button or switch that allows a user to override the actions of the controller 214.

The RF interface 218 receives signals from a transmitter 222. These signals can be used to actuate the barrier arm 202.

The motor 212 and other components of the system are connected to a power supply 234 via a power line 232. A detector 230 determines whether a power outage has occurred (i.e., power from the power supply 234 is no longer detected).

The telescoping barrier arm 202 includes a first member 204, a second member 206, and a third member 208. A sensor 224 is positioned at the tip of the first member 204. The sensor 224 can be contained within the operator 200 in such a way that it can still sense an obstruction at the tip of the barrier. In the extended position, the second member 206 extends from the third member 208 and the first member 204 extends from the second member 206. It will be appreciated that any number of members can be used. It will also be understood that various mechanisms such as springs (not shown) can be used between the members 203, 204, and 206 to allow the motor 212 and motor arm interface 210 to end and retract the telescoping arm 202.

The motor arm interface 212 includes one or more circuits and/or mechanisms that allow the motor to extend and retract the telescoping arm 202. In this regard, the motor arm interface may include springs, gears, pulleys or any other type of mechanism or circuit that allow the motor to drive the telescoping arm from a retracted position to an extended position and vice versa.

The sensor interface 216 converts signals received from the sensor 224 and the external sensor 220 into a format useable by the controller 214. Similarly, the RF interface 218 converts signals received from the transmitter 222 into a format usable by the controller 214.

In one example of the operation of the system of FIG. 2, the motor 212 is activated to move the telescoping barrier arm 202 from a retracted position to an extended position and retract the arm from the extended position to the retracted position.

The sensor 224 provides a secondary safety device to protect the telescoping barrier arm 202 from contacting an object in the pathway of the telescoping barrier arm 202. As shown, the sensor 224 may be positioned to protect the tip of the arm 202 from impacts with obstructions.

As mentioned, the detector 230 may be used to detect whether a power outage has occurred and communicates this information to the controller 214. In one example, the controller 214 may be programmed to actuate the motor upon detection of a power outage and the barrier arm 202 may be retracted, held in a current position, or extended. In another example, a manual override mechanism (e.g., indicator 228) may allow for the manual override actions of the controller 214.

The system may be operated according to various modes of operation. For example, the controller 214 may operate the telescoping barrier arm 202 in a failsafe mode that allows a user to escape the telescoping barrier arm 202 upon detection of a predetermined condition such as a collision with the user. In another example, the controller 214 may operate the telescoping barrier arm 202 in a fail-secure mode that excludes users from entering a secure area protected by the operator upon detection of a predetermined condition such as the detection of an unauthorized attempt to gain entry to the secure area. The system may be operated in other modes as well.

Referring now to FIG. 3*a*, a cross sectional view of a telescoping barrier arm in the extended position is described. A telescoping arm 300 includes a first member 302, second member 304, and third member 306. The member 304 extends outward from the member 306 and the member 302 extends outward from the member 304. Each of the members 302, 304, and 306 are hollow. The width of the first member 302 is less than the width of the second member 304. The width of the second member 304 is less than the width of the third member 306. The members 302, 304, and 306 may be constructed from metal, wood, or any suitable natural or synthetic material.

A sensor 312 is provided at the tip of the member 302. The sensor 312 detects the presence of objects in the path of the arm 300 as the arm 300 extends. The sensor 312 may be a photobeam detector (retro-reflective object detecting), proximity detector (e.g., a capacitive sensor), or a pressure detector to give some examples.

A spring 308 is used to push the member 302 outward of the member 304. A spring 310 is used to push the member 304 outward from the member 306. A motor and other mechanical components (not shown) can be used as is known in the art to move the springs and extend and retract the members 302, 304, and 306.

Referring now to FIG. 3*b,a* cross sectional view of a telescoping barrier arm in the retracted position is described. As shown, the first member 302 has been retracted into the second member 304 and the first and second members 302 and 304 have be retracted into the third member 306. The springs 308 and 310 have been compressed as a result of the retraction.

Figure 4A:
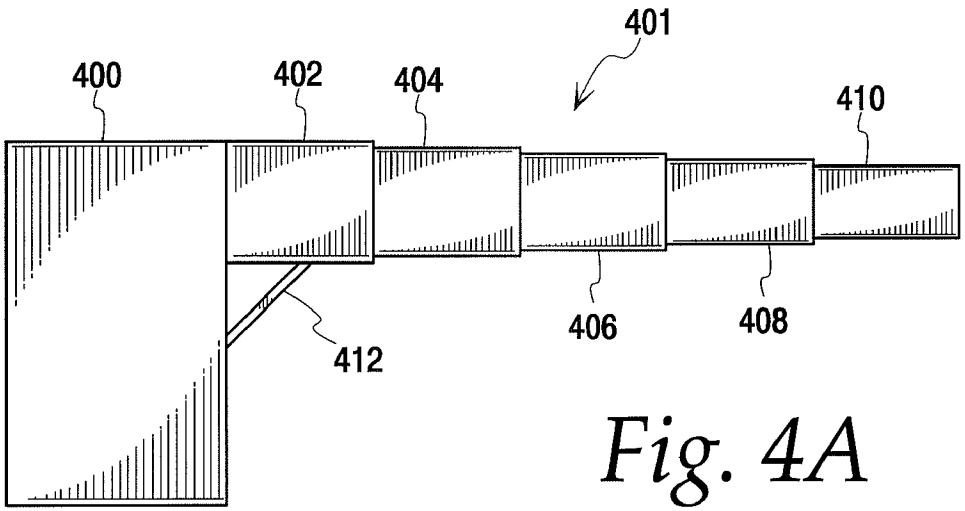
FIG. 4*a* is a side view of a barrier operator system with a telescoping arm on the exterior of the operator chassis and with the arm extended according to the present invention.
Figure 4B:
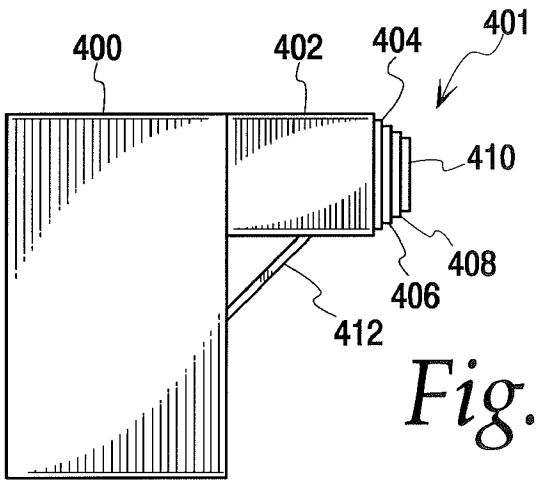
FIG. 4*b* is a side view of a barrier operator system with a telescoping arm on the exterior of the operator chassis and with the arm retracted according to the present invention.

Referring now to FIGS. 4*a* and 4*b*, another example of a barrier system using a telescoping barrier arm is described. A moveable barrier operator system includes a chassis 400. The chassis 400 houses a controller, a motor, and a mechanism for extending and retracting a telescoping barrier arm 401. In this example, the barrier arm 401 includes a first member 410, a second member 408, a third member 406, a fourth member 404, and a fifth member 402. A supporting member 412 provides support and strength to hold the members 402, 404, 406, 408, and 410 upright. For example, the supporting member may be one or more brackets or similar devices.

Each of the members 402, 404, 406, 408, and 410 are hollow. In one approach, the width of the first member 402 is greater than the width of the second member 404. The width of the second member 404 is greater than the width of the third member 406. The width of the third member 406 is greater than the width of the third member 408. Finally, the width of the second member 408 is greater than the width of the third member 410.

In this example and now referring to FIG. 4*b*, when in the retracted position, the first member 410 is housed within the second member 408. Together, the first and second members 410 and 408 are housed within the third member 406. The first, second and third members 410, 408, and 406 are housed within the fourth member 404. Finally, when fully retracted, the first, second, third, and fourth members 419, 408, 406, and 404 are housed within the fifth member 402. In this example, the retracted members remain on the outside of the chassis 400. As mentioned, the supporting member 412 provides support and strength to hold the members 402, 404, 406, 408, and 410 upright.

Thus, a barrier operator having a telescoping arm is provided. The telescoping arm saves space and does not require an open arc of space above the arm in order to open. Since arcuate movement of the arm is not needed, only the tip portion of the arm need be protected from obstructions, resulting in a simpler and less expensive system.

While there has been illustrated and described particular embodiments of the present invention, it will be appreciated that numerous changes and modifications will occur to those skilled in the art, and it is intended in the appended claims to cover all those changes and modifications which fall within the true scope of the present invention.

What is claimed is:

1. A moveable barrier operator system comprising:

an elongated barrier arm which moves parallel to the ground from a housing which is fixed in relation to the ground, the elongated arm having a longitudinal axis, the elongated barrier arm moving in a telescoping manner along the longitudinal axis only in a direction generally parallel to the ground;

a safety sensor coupled to the elongated barrier arm, the safety sensor configured to detect obstructions generally along the direction of horizontal movement of the elongated barrier arm;

a motor coupled to the telescoping barrier arm for extending the elongated barrier arm from a retracted position to an extended position and retracting the elongated barrier arm from the extended position to the retracted position;

an interface that is configured to receive control signals, the control signals selected from the group consisting of radio frequency (RF) control signals, control signals from a magnetic loop, and control signals received via a hardwired connection; and a controller coupled to the motor, the safety sensor, and the interface for selectively activating the motor to extend and retract the arm, the controller activating the motor according to the control signals received from the interface.

2. The movable barrier operator system of claim 1 wherein the elongated barrier arm includes a proximal end and a distal end and the safety sensor is disposed at the distal end of the arm and is configured to sense obstructions located in a generally forward direction of movement of the elongated barrier arm.

3. The moveable barrier operator system of claim 1 comprising a detector for automatically detecting a power outage.

4. The moveable barrier operator system of claim 3 wherein the controller is programmed to actuate the motor upon detection of a power outage and performing an arm function selected from a group comprising retracting the elongated barrier arm, holding the elongated barrier arm in a current position, and extending the elongated barrier arm.

5. The moveable barrier operator system of claim 1 wherein the controller retracts the elongated barrier arm upon detection of a predetermined condition.

6. The moveable barrier operator of claim 5 wherein the predetermined condition is a detection of a collision with the user.

7. The moveable barrier operator system of claim 1 wherein the controller operates the elongated barrier arm in a fail-secure mode that excludes users from entering a secure area protected by the operator upon detection of a predetermined condition.

8. The moveable barrier operator system of claim 7 wherein the predetermined condition is a detection of an unauthorized attempt to gain entry to the secure area.

9. The moveable barrier operator system of claim 1 wherein the motor drives the elongated barrier arm with a spring.

10. The moveable barrier operator system of claim 1 comprising a manual override mechanism to manually override actions of the controller.

11. A method of providing entry protection for a secure area comprising:

providing an elongated barrier arm, the elongated arm having a longitudinal axis;

moving the elongated barrier arm parallel to the ground from a housing that is in fixed relation to the ground, the elongated barrier arm moving in a telescoping manner along the longitudinal axis only in a direction generally parallel to the ground;

receiving control signals, the control signals selected from the group consisting of radio frequency (RE) control signals, control signals received from a magnetic loop, and control signals received via a hardwired connection; and selectively extending and retracting the telescoping arm from a retracted position to an extended position and vice versa using a motor according to the received control signals; and detecting obstructions generally along the direction of movement of the telescoping barrier arm.

12. The method of claim 11 wherein the elongated barrier arm includes a proximal end and a distal end and further comprising disposing the safety sensor at the distal end of the arm and sensing obstructions located in a generally forward direction of movement of the elongated barrier arm.

13. The method of claim 11 comprising automatically detecting a power outage.

14. The method of claim 13 comprising actuating the motor upon detection of a power outage and responsively performing an arm function selected from a group comprising retracting the elongated barrier arm, holding the elongated barrier arm in a current position, and extending the elongated barrier arm.

15. The method of claim 11 comprising retracting the elongated barrier arm upon detection of a predetermined condition.

16. The method of claim 15 wherein the predetermined condition is a detection of a collision with the user.

17. The method of claim 11 comprising operating the elongated barrier arm in a fail-secure mode that excludes users from entering a secure area protected by the operator upon detection of a predetermined condition.

18. The method of claim 17 wherein the predetermined condition is a detection of an unauthorized attempt to gain entry to the secure area.

19. The method of claim 11 wherein extending and retracting the elongated barrier arm comprises driving the elongated barrier arm with a spring.

20. The method of claim 11 comprising providing a manual override mechanism to manually override actions of the system.

21. A moveable barrier operator system comprising:

an elongated barrier arm, the elongated arm having a longitudinal axis, the elongated barrier arm moving in a telescoping manner along the longitudinal axis only in a direction generally parallel to the ground;

a safety sensor coupled to the elongated barrier arm, the safety sensor configured to detect obstructions generally along the direction of horizontal movement of the elongated barrier arms;

a motor coupled to the elongated barrier arm for extending the elongated barrier arm from a retracted position to an extended position and retracting the elongated barrier arm from the extended position to the retracted position; and a controller coupled to the motor and the secondary safety device for automatically activating the motor to extend and retract the elongated barrier arm when the obstruction is detected by the safety sensor.

* * * * *

UNITED STATES PATENT AND TRADEMARK OFFICE

CERTIFICATE OF CORRECTION

PATENT NO. : 7,481,598 B2
APPLICATION NO. : 11/497498
DATED : January 27, 2009
INVENTOR(S) : Tom J. Jankovsky It is certified that error appears in the above-identified patent and that said Letters Patent is hereby corrected as shown below:

ON THE TITLE PAGE

Item (75); Change "South Elgin" to -- Elgin --.

Claim 11, Column 7, Line 32; Change "(RE)" to -- (RF) --.

Claim 21, Column 8, Line 35; Change "arms" to -- arm --.

Signed and Sealed this

Third Day of November, 2009

David J. Kappos

David J. Kappos
*Director of the United States Patent and Trademark Office*